US011553744B2

(12) United States Patent
Wang et al.

(10) Patent No.: US 11,553,744 B2
(45) Date of Patent: Jan. 17, 2023

(54) FOLDED SURGICAL GOWN AND METHOD OF FOLDING SAME

(71) Applicant: Allegiance Corporation, Waukegan, IL (US)

(72) Inventors: Sheng Hua Wang, Shanghai (CN); Ti Lu, Shanghai (CN)

(73) Assignee: Allegiance Corporation, Waukegan, IL (US)

( * ) Notice: Subject to any disclaimer, the term of this patent is extended or adjusted under 35 U.S.C. 154(b) by 1087 days.

(21) Appl. No.: 16/071,042

(22) PCT Filed: Jan. 19, 2016

(86) PCT No.: PCT/CN2016/000039
§ 371 (c)(1),
(2) Date: Jul. 18, 2018

(87) PCT Pub. No.: WO2017/124205
PCT Pub. Date: Jul. 27, 2017

(65) Prior Publication Data

US 2021/0076760 A1 Mar. 18, 2021

(51) Int. Cl.
*A41D 13/12* (2006.01)
*B65B 5/04* (2006.01)
(Continued)

(52) U.S. Cl.
CPC ..... *A41D 13/1209* (2013.01); *A41D 13/129* (2013.01); *B65B 5/04* (2013.01);
(Continued)

(58) Field of Classification Search
CPC ..... A41D 13/1209; A41D 13/129; A41D 2400/44; B65B 5/04; B65B 5/06; B65B 55/02; B65B 63/045
See application file for complete search history.

(56) References Cited

U.S. PATENT DOCUMENTS 3,359,569 A * 12/1967 Scrivens ..... A41D 13/1209 2/114
3,424,153 A * 1/1969 Lewis, Jr. ..... A61B 46/30 128/856
(Continued)

FOREIGN PATENT DOCUMENTS

CN 1927080 A * 3/2007
CN 1927080 A 3/2007
(Continued)

OTHER PUBLICATIONS

International Preliminary Report on Patentability Chapter I for Application No. PCT/CN2016/000039, dated Aug. 2, 2018, 6 pages.
(Continued)

*Primary Examiner* — F Griffin Hall
(74) *Attorney, Agent, or Firm* — ArentFox Schiff LLP

(57) ABSTRACT

A surgical gown folded in a unique pattern that provides for a smaller sized gown that can be packaged in a smaller sized outer wrap as well as provide for an easily donnable gown that maintains its sterility. The fold pattern provides for the interior surfaces of the gown to be visible, and preferably, a portion of the interior surfaces, while maintaining sterility of the exterior surfaces by keeping them inside of the gown. A method of folding the gown in this new pattern is provided herein as well as a method of donning the folded gown.

18 Claims, 15 Drawing Sheets

(51) Int. Cl.

| | |
|---|---|
| ***B65B 5/06*** | (2006.01) |
| ***B65B 55/02*** | (2006.01) |
| ***B65B 63/04*** | (2006.01) |
| ***D06F 89/02*** | (2006.01) |

(52) U.S. Cl.

CPC ..... *B65B 5/06* (2013.01); *B65B 55/02* (2013.01); *B65B 63/045* (2013.01); *D06F 89/02* (2013.01); *A41D 2400/44* (2013.01)

(56) References Cited

U.S. PATENT DOCUMENTS

| | | | | |
|---|---|---|---|---|
| 3,721,999 | A * | 3/1973 | Goya | A41D 13/1209 206/278 |
| 4,523,335 | A * | 6/1985 | Scrivens | A41D 13/1209 2/114 |
| 4,942,987 | A | 7/1990 | Stackhouse et al. | |
| 5,097,534 | A | 3/1992 | Viemeister et al. | |
| 5,862,525 | A | 1/1999 | Tankersley et al. | |
| 6,062,444 | A * | 5/2000 | Tankersley | D06F 89/02 223/37 |
| 9,731,891 | B2 * | 8/2017 | Vellutato, Jr. | B65D 85/18 |
| 2011/0024485 | A1 | 2/2011 | Porowski et al. | |
| 2013/0105511 | A1 * | 5/2013 | Graneto, III | B65D 83/0805 493/405 |

FOREIGN PATENT DOCUMENTS

| | | |
|---|---|---|
| IN | 02/2013 | 1/2013 |
| JP | H0889561 A | 4/1996 |
| JP | H1136114 A | 2/1999 |

OTHER PUBLICATIONS

International Search Report and the Written Opinion for International Application No. PCT/CN2016/000039, dated Oct. 2016, 12 pages.

* cited by examiner

FOLDED SURGICAL GOWN AND METHOD OF FOLDING SAME

FIELD

A folded surgical gown for use in hospital or medical settings is provided herein and methods of folding the surgical gown to obtain a reduced footprint for packaging purposes and that helps to maintain sterility of the folded gown during packaging and prior to use. A method of donning the folded gown is also disclosed herein.

BACKGROUND

Surgical gowns are often worn by medical personnel and doctors during surgical and medical procedures to maintain sterility in the medical setting by protecting the patient from contamination that may be found on the clothes of the wearer as well as protecting the clothes of the wearer from becoming saturated with blood or other fluids that may be present during these medical procedures. Such gowns are used frequently by health care professionals to act as a barrier between the wearer and the medical environment/patient to minimize the spread of infectious diseases.

Surgical gowns are often provided in a folded arrangement for ease of transportation and/or to preserve sterile surfaces. Many of these prior folded gowns are provided with additional features, such as a grasp or pull-tab, that is an extra section of the gown or an extra piece of material manufactured onto the gown to be used as a handhold to pull down upon when unfolding the gown or donning the gown, essentially used as an anchoring point for the wearer to either pull on or use as a handhold to unfold the gown. This grasping pull-tab can create an extra step for the wearer when having to unfold and don the gown as well as an extra step in manufacturing when an extra piece has to be added onto the gown.

In some instances, the folded gown size may end up being large due to the need to be able to easily unfold the gown when in the medical setting and in an effort to avoid complicated folding patterns. Another issue with folded gowns is that there can be wrinkles present in the folds. The gowns may be loosely folded, such that after they are unfolded from their overwrap the gowns become wrinkled, giving the gown a look like it has been used or is not clean. Moreover, the larger folded gown size requires larger packaging and cases for shipping, which can increase the cost of the gowns.

SUMMARY

A folded surgical gown is provided that ensures maintaining sterility of the folded sterilized gown yet provides a smaller footprint for the folded gown for packaging and transporting purposes. The smaller fold pattern results in smaller packaging and case sizes which can improve loading efficiency of the folded, packaged gowns and can reduce the cost for shipping and making the surgical gowns. In addition, this smaller fold pattern can help to reduce or avoid the presence of wrinkles in the folded gown.

The surgical gown folded in the manner described herein can maintain the exterior surfaces of the gown, i.e., found in an interior position in the folded gown, in a sterile condition prior to use yet provides a controlled fashion of unfolding the gown when donning the gown as well as an easy manner of donning the gown. The folded gown can be donned in an unassisted manner by the wearer while still maintaining sterility of the gown as it is donned. Moreover, there is no need for a pull-tab or grasping piece that the wearer has to grab and pull prior to putting on the gown in order to unfold it or to don the gown.

The gown can include a body portion having a back panel and a front panel that can be a continuous piece of material or could be separate panels sewn together. The body portion can further be defined by a bottom edge at the lower portion and a collar at the upper portion. The back panel of the body portion can be open in the middle section to allow for donning. A belt can be provided with the gown and can be used to hold the gown in place and, in particular, to close the opening in the back panel. The gown can have sleeves, where the sleeves can be attached to a front panel of the gown at an upper section, and a collar portion as well. The folded gown can be folded such that only a small portion of the collar of the gown is exposed along the interior of the collar as well as a small portion of the interior of the gown along the inner shoulder portion, sleeve and upper chest portion.

The method of folding the gown can comprise folding two outer side edges of the gown that define the opening in the back panel, such that the two outer edges can be folded longitudinally inward toward a central axis, and then can be partially folded back upon itself. The two side edges can first be folded such that the side edges can be adjacent one another and can then be folded partially back in a reverse direction, such that the side edges can be folded about one quarter of the way towards the central axis.

The sleeves can then be folded across one another, on the opposite side of the gown having the longitudinal folds. Then the bottom edge can be folded up approximately in half toward the collar portion in either a single fold upward just to the bottom edge of the collar portion or one fold upward and a second fold back to fold the bottom edge slightly back to uncover the collar portion. The number of folds in this step is determined by where the bottom edge ends up; if it covers the collar portion, then a second fold may be warranted to uncover the collar. This fold upward of the bottom edge is perpendicular to the central axis and covers the folded sleeves. Two subsequent folds can be made in the same direction approximately in half each time to fold a lower folded edge up toward the collar portion, each time folding the gown along a horizontal fold line across the gown essentially folding the gown in half and in half again.

After the gown has been folded up toward the collar in three fold steps, then the outer edges of the gown can be folded in toward a central axis of the gown along a vertical fold line, approximately in half toward each other. Once the outer edges have been folded in, such that the two outer edges can be adjacent one another, the gown can be folded in half along the central axis line one more time to result in the final folded gown. Once in the folded position, the gown exposes its interior surfaces, and preferably only a portion of its interior surfaces, which are the surfaces in contact with the clothes of the wearer and do not need to maintain sterility. The exterior surfaces of the gown are not exposed and, thus, are able to maintain its sterility during the donning step.

The wearer of the gown dons the gown by inserting their hands first into two pockets or flaps on either side of the folded gown and at the same time open the final fold of the gown by spreading their arms out toward the outer sides of their body. As this movement is made, the gown opens up and begins to unravel the folded layers until the gown is completely unfolded. The wearer can further insert their hands and arms into the sleeves to fully don the gown and then close it in back using a belt or tie.

One of the advantages of the folded gown as described herein is that only the interior surfaces of the gown are exposed, thus maintaining sterility on the exterior portion of the gown, which would come into contact with the environment of the hospital and possibly with the patient. Another advantage is the smaller size of the gown allows for smaller carton or case sizes when packaging the gowns for shipment, thus improving loading efficiency and saving money on packaging costs. Yet another advantage of the folded gown described herein is that this type of fold helps to avoid or overcome wrinkles evident in a larger size folded gown, thus providing a gown with a smoother fold and that avoids looking wrinkled and used, which is much more aesthetically pleasing.

DETAILED DESCRIPTION

A folded surgical gown, method of folding the gown, and method of donning the gown are described herein and provided in FIGS. 1-15.

Figure 1:
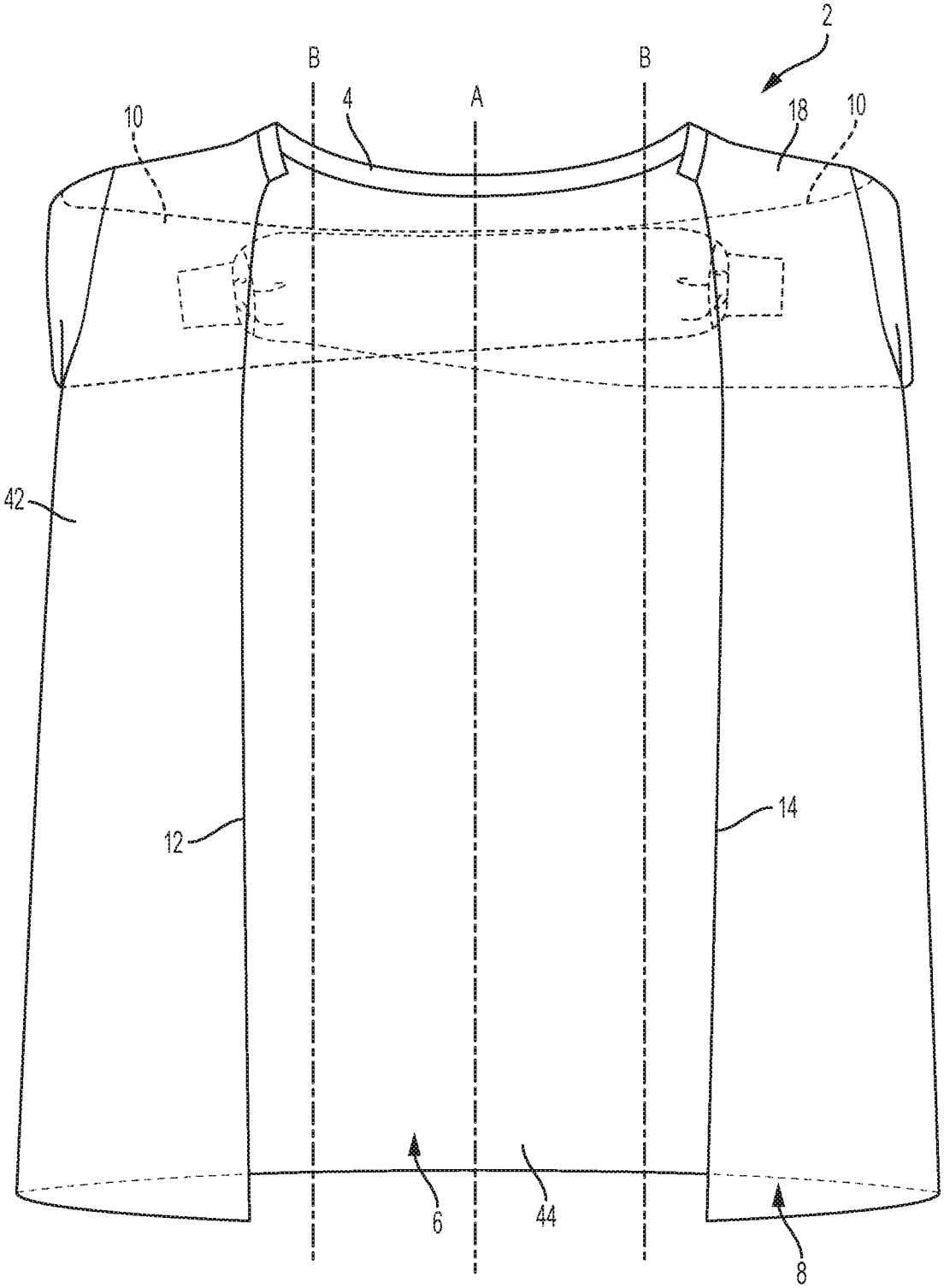
FIG. 1 is a plan view of a surgical gown showing the first step in a first embodiment of folding the gown disclosed herein.

The gown used for folding can be any type of standard surgical gown having an opening therein with an exterior surface in contact with the patient and/or the environment, and an interior surface that is in contact with the clothes of the wearer. The gown 2, as shown in FIG. 1, can have a collar 4 that is near the top edge of the gown. The gown can have a belt or other type of tying means that wraps around the gown and waist area of the wearer. The belt or tying means can be used to close the gown after the wearer has donned the gown. The gown is usually worn with the opening in the back of the wearer, and then the belt or tying means can be used to keep the gown in place and relatively closed in back. In the unused gown, upon unfolding the gown a tab or other identifier may be attached to the belt or tying means. This tab typically conveys information about the gown to the wearer, such as size, sterilization standard, etc. Any type of information useful to the wearer can be added to this tab. Thus, where the belt and tab are positioned on the unfolded gown determines where the second fold of the gown is positioned. This will be explained in more detail below.

Once the gown is donned, there is a front portion that is in contact with the front area of the wearer's body and a back portion that is in contact with the wearer's back. The gown can also have sleeves 10 which are used as the first step in donning the folded gown described herein. The length of the gown can vary depending on the height of the person and the size of the gown desired, however, all gowns will have a bottom edge 16 that goes all the way around the front and back portions. When the gown is placed on a flat surface in an open condition, as in FIG. 1, the opening area of the gown is bordered by two side edges, 12 and 14.

Figure 2:
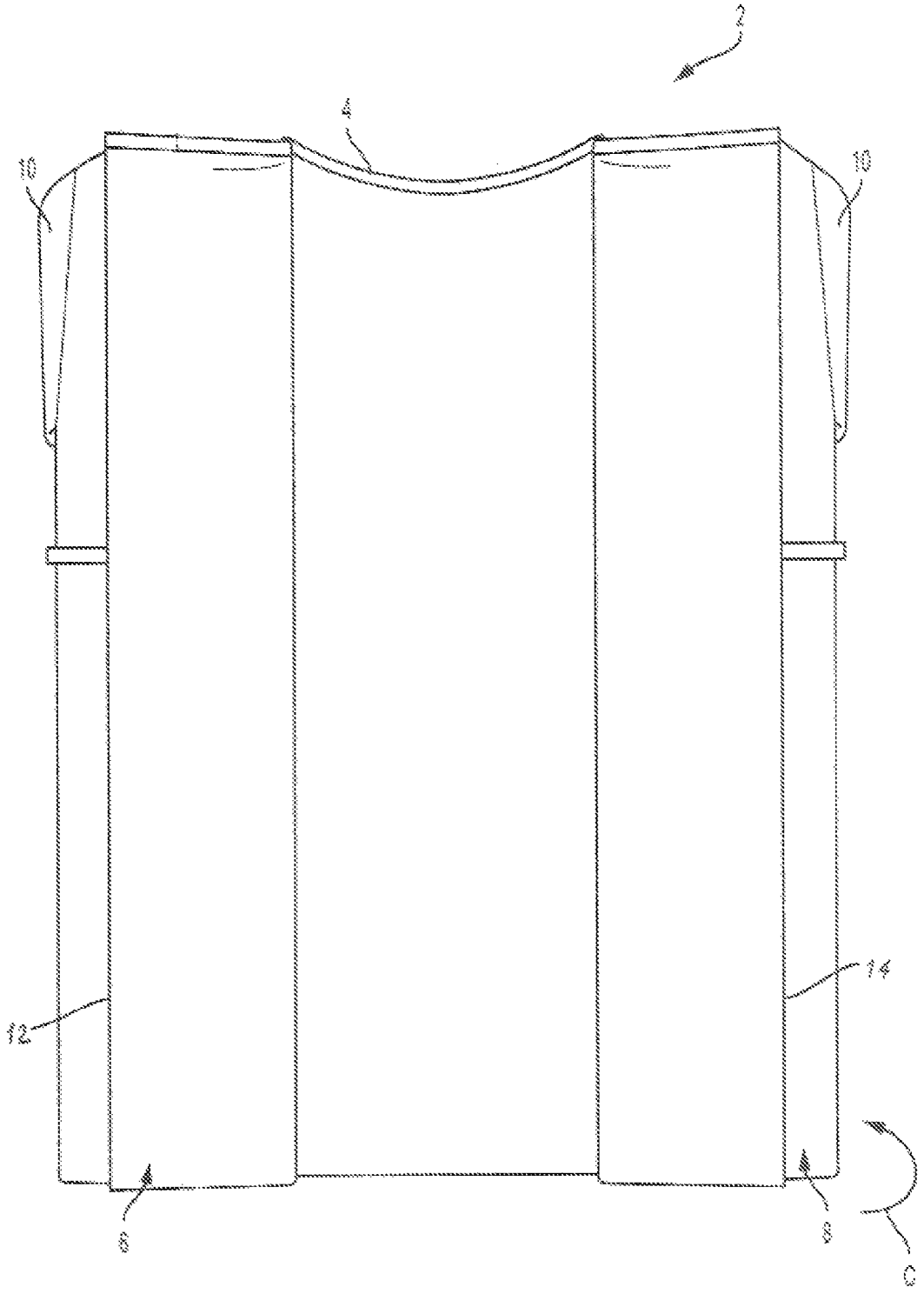
FIG. 2 is a plan view of the surgical gown of FIG. 1 showing the second step of folding the gown.

Turning to FIGS. 1-8, a first embodiment of folding a surgical gown 2 is shown. In FIG. 1, an unfolded surgical gown 2 is shown before the folding process begins, where it is laid out in a flat position. The gown is shown in an unfolded state with the interior of the gown (i.e., clothing contacting side, which contacts the wearer) facing upward, while the exterior of the gown is underneath on the opposite side. The first step in folding the gown 2 is to place the surgical gown 2 in the opened position shown in FIG. 1. The interior surface 6 of the gown is facing outward or upward, and the exterior surface 8 of the gown is on the opposite side in contact with the folding surface or table. The sleeves 10 of the gown are also placed underneath the gown in contact with the folding surface. The first folds are made by grasping the outer side edges 12 and 14 of the gown and folding them over and toward a central axis A, such that the gown is almost completely closed. After folding the sides of the gown towards the middle, the side edges 12 and 14 are grasped again and folded back along fold lines B, shown in FIG. 1, where the two sides of the gown are folded back upon themselves away from the central axis A. This results in the interior surface 6 of the gown being exposed again. The fold that results is shown in FIG. 2.

The gown is then flipped over and reversed, as indicated by arrow C in FIG. 2, such that the underside of the gown (i.e., the exterior 8) is now facing upward and is now the part of the gown exposed. Accordingly, after reversing the gown the underside of the gown now becomes the interior of the gown that is in contact with the folding surface or table, Upon reversing the gown in this fashion, the sleeves of the gown are also crossed over one another, the end result illustrated in FIG. 3. It is preferable that the sleeves are folded such that the lower edge of the sleeve is approximately parallel to and adjacent the belt, if present, and, in particular, that the lower folded edge of the sleeve is above a tab portion, if present.

Figure 3:
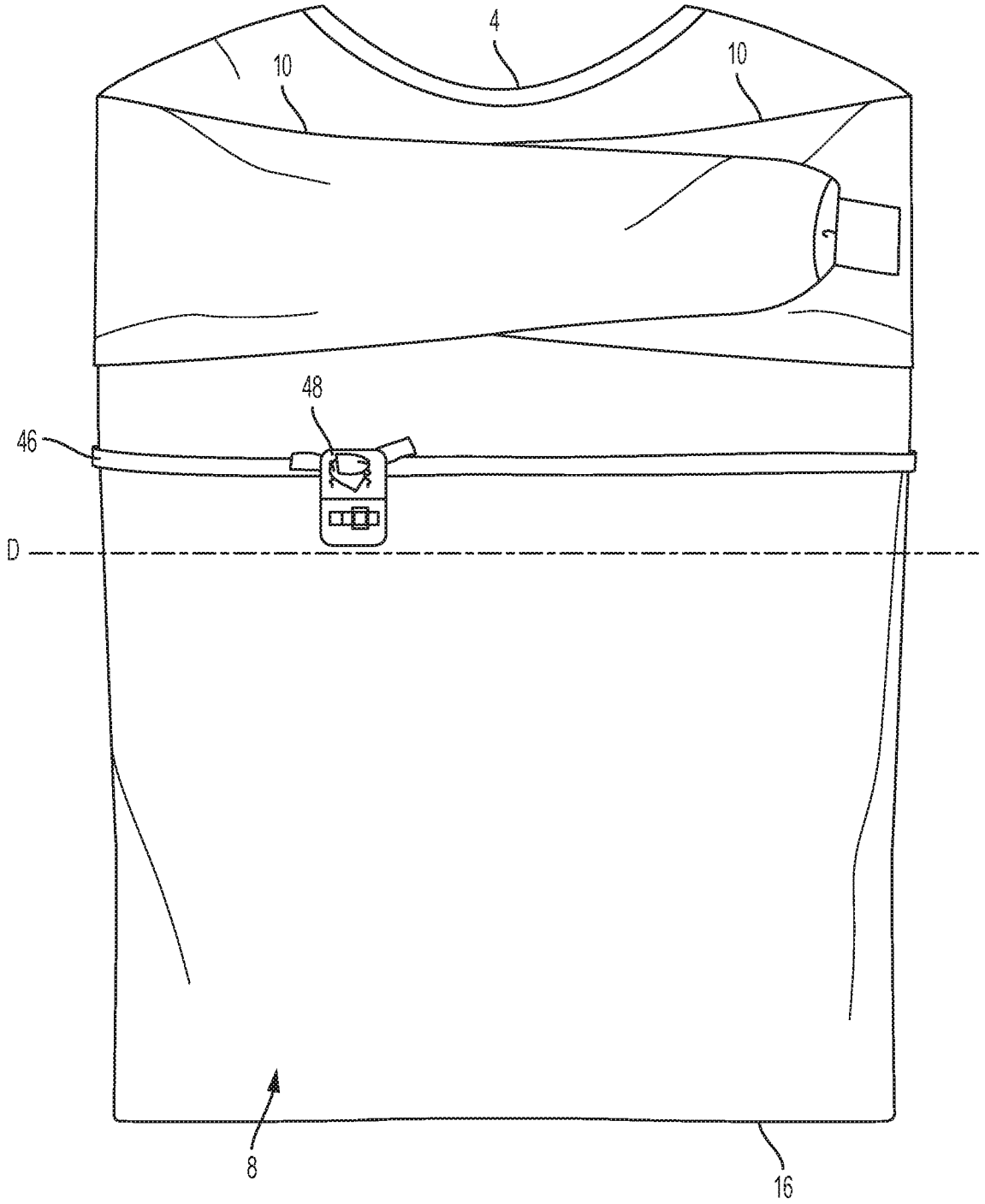
FIG. 3 is a plan view of the surgical gown of FIG. 1 showing the third step in folding the gown.
Figure 4:
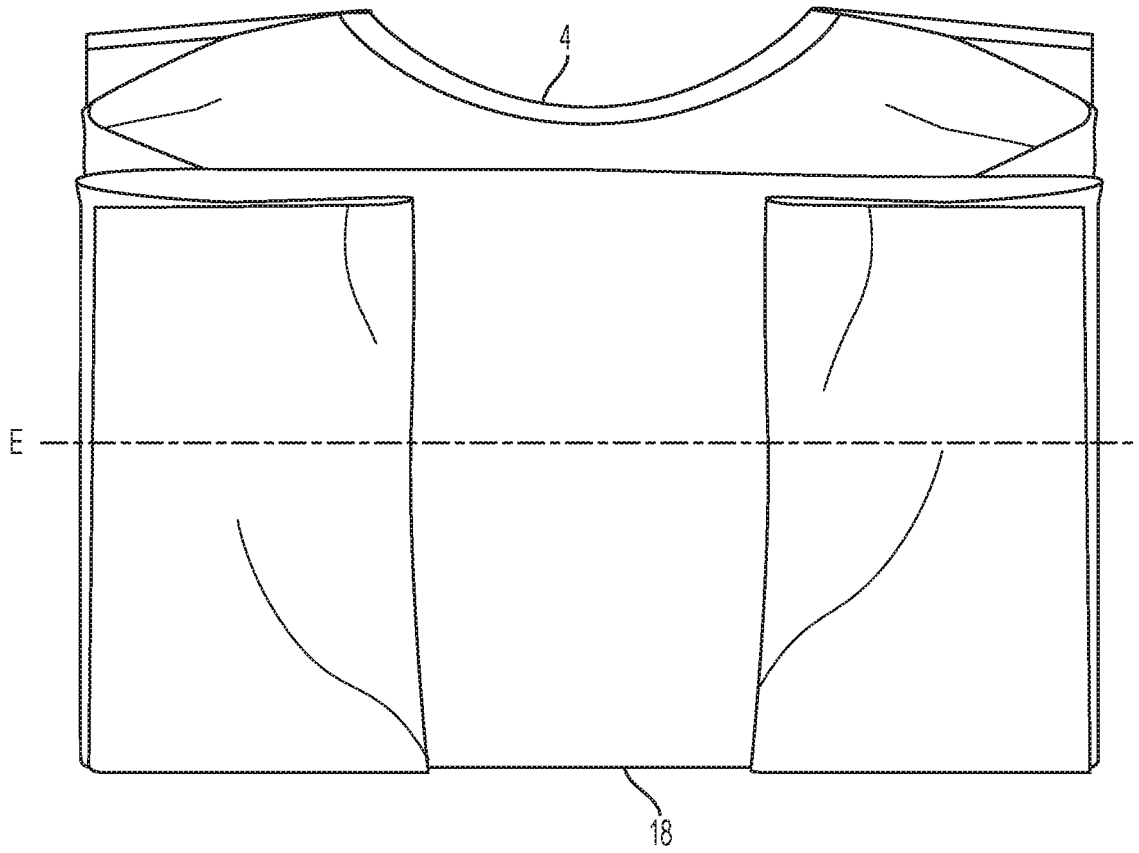
FIG. 4 is a plan view of the surgical gown of FIG. 1 showing the fourth step in folding the gown.

The next fold is made along line D, as shown in FIG. 3, such that the bottom edge 16 of the gown is folded upward along line D toward the collar portion 4 of the gown, essentially folding the lower half of the gown upward toward the upper half of the gown, stopping just short of the bottom edge of the collar. The fold that results is shown in FIG. 4. In positioning fold line D, it is preferable that this fold line is placed below the belt of the gown and tab, if present, such that the fold does not envelop or bend either the belt or tab, if present. In this regard, the positioning of the belt (and tab) can be used as a fold guide to help determine the position of fold line D, as it is undesirable to place fold line D in a position where the tab may be bent or folded along with the gown. It is preferable to avoid bending or folding the tab during this fold step. Thus, it is preferable to position fold line D just below either the tab or belt at the lowermost edge of the tab or belt, depending on which are present on the gown. Once the bottom edge 16 of the gown is folded upward, the bottom edge 16 is just below or flush with the edge of the collar 4. Thus, the edge of the collar 4 is still visible or at least partially visible after this folding step.

Figure 5:
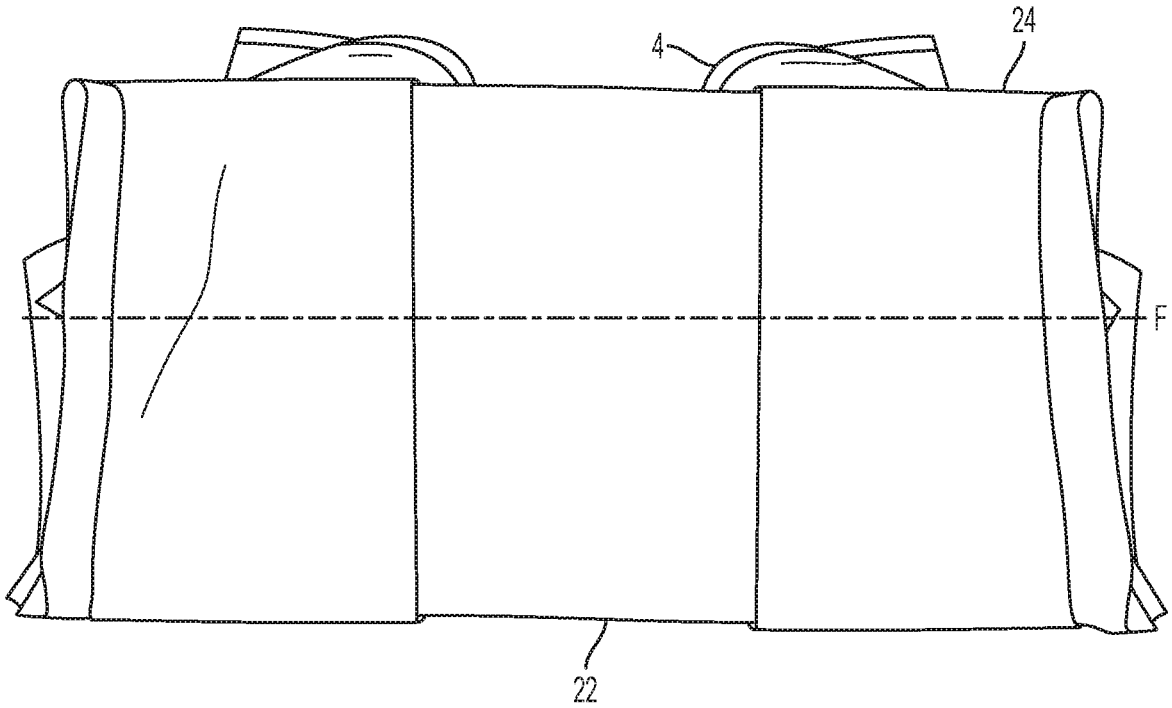
FIG. 5 is a plan view of the surgical gown of FIG. 1 showing the fifth step in folding the gown.

The gown is then folded along line E, shown in FIG. 4, such that the gown is folded in half toward the collar portion, where the fold line E is perpendicular to the central axis A. The lower folded edge 18 is folded upward along line E toward the collar 4. The collar portion is left exposed at the top. The fold that results is shown in FIG. 5. The gown is further folded along line F, indicated in FIG. 5, taking the lower folded edge 22 and folding it upward along line F toward the upper part of the folded edge 24 and toward the collar 4. The fold that results is shown in FIG. 6.

Figure 6:
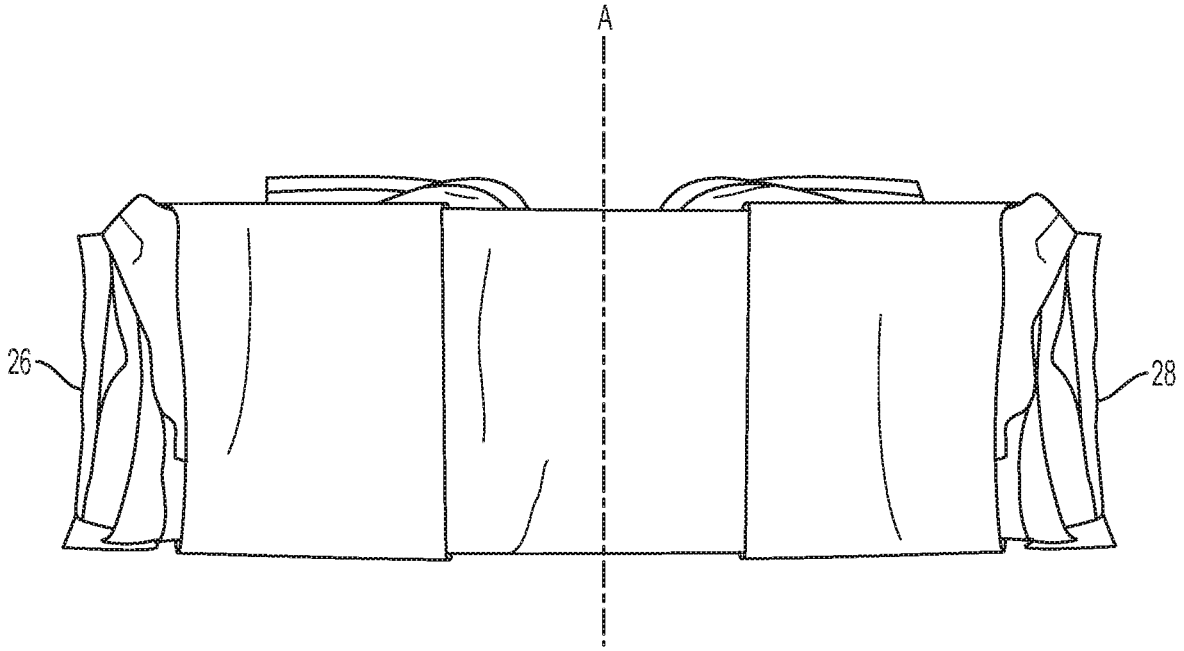
FIG. 6 is a plan view of the surgical gown of FIG. 1 showing the sixth step in folding the gown.
Figure 7:
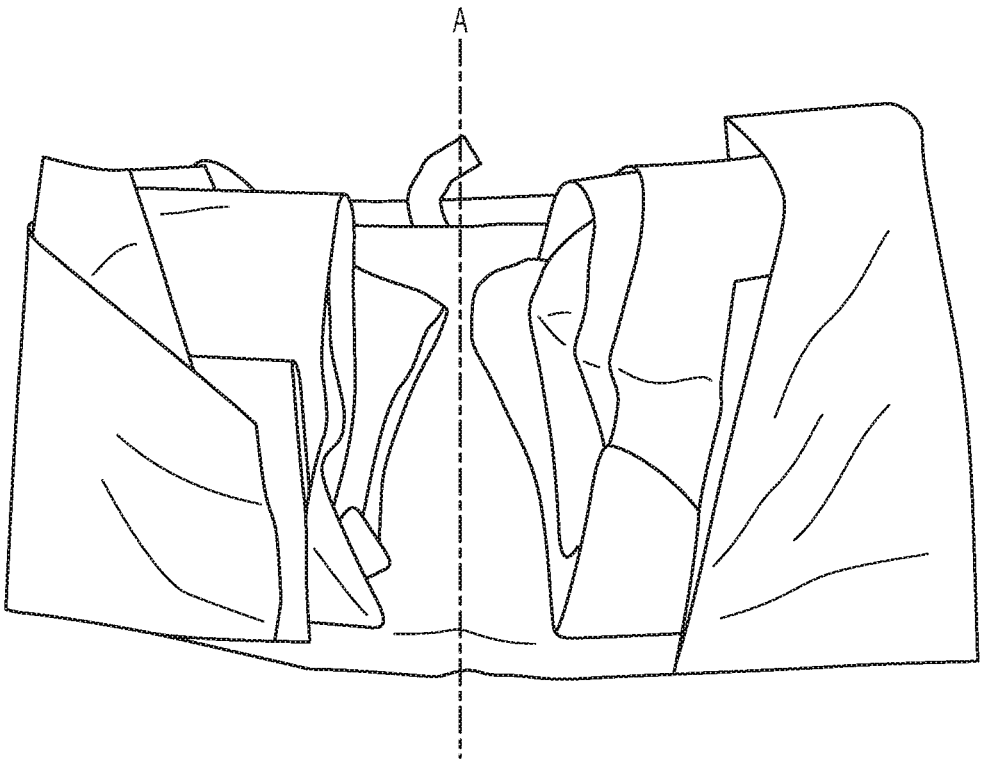
FIG. 7 is a plan view of the surgical gown of FIG. 1 showing the seventh step in folding the gown.
Figure 8:
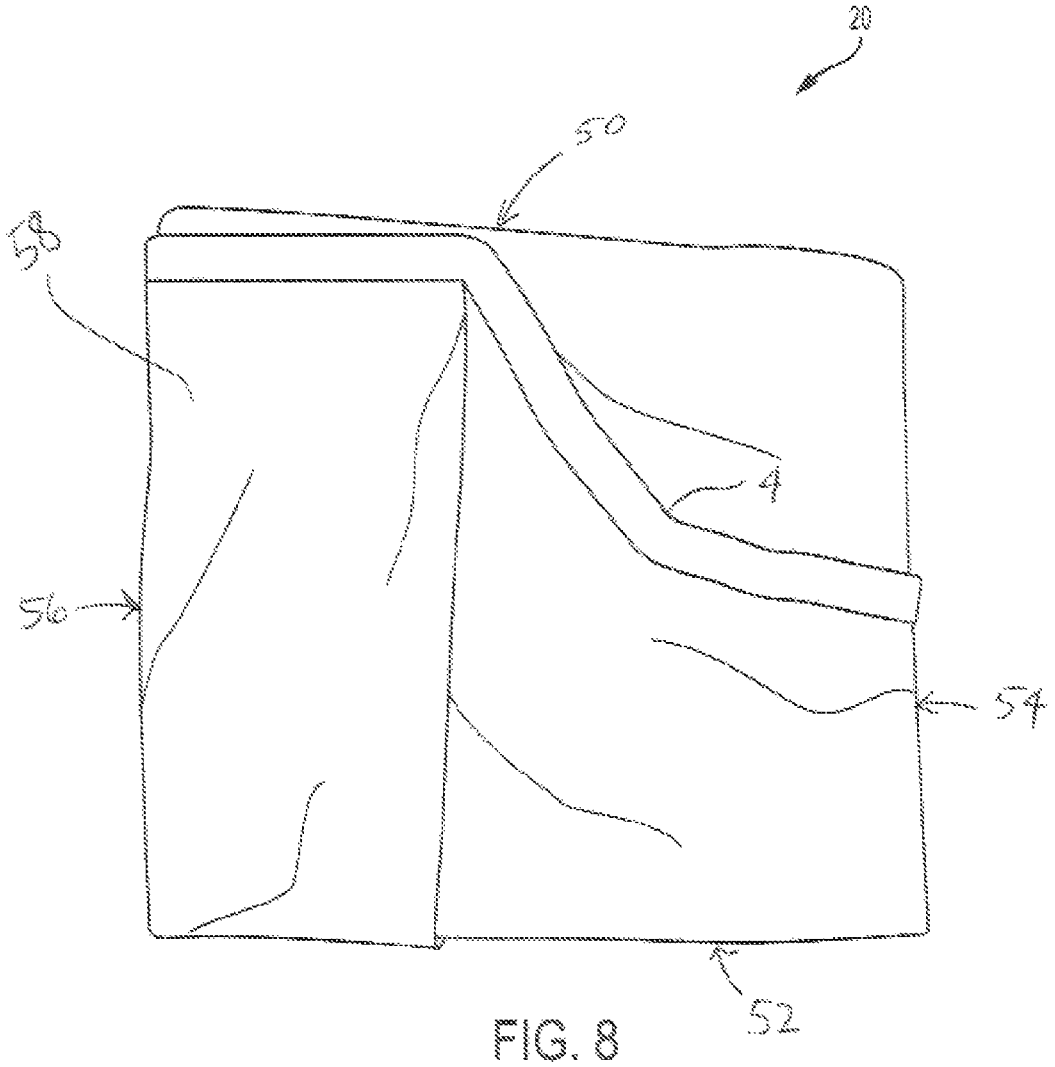
FIG. 8 is a plan view of the finally folded gown of FIG. 1.

The next step in folding the gown is to fold the side edges, 26 and 28 inward toward central axis A, as shown in FIG. 6, with the fold that results shown in FIG. 7. The final fold that takes place is to fold the gown in half once more along central axis A, The final fold that results is shown in FIG. 8. The folded gown of FIG. 8 is the final folded gown 20 that can then be packaged, for example, in a plastic overwrap and then shipped. The method of packaging the folded gown can be any method that is standard in the industry. The final folded footprint or dimensions of the gown can be about 7.5 inches×about 7.5 inches, or any other appropriate dimension desired.

Figure 9:
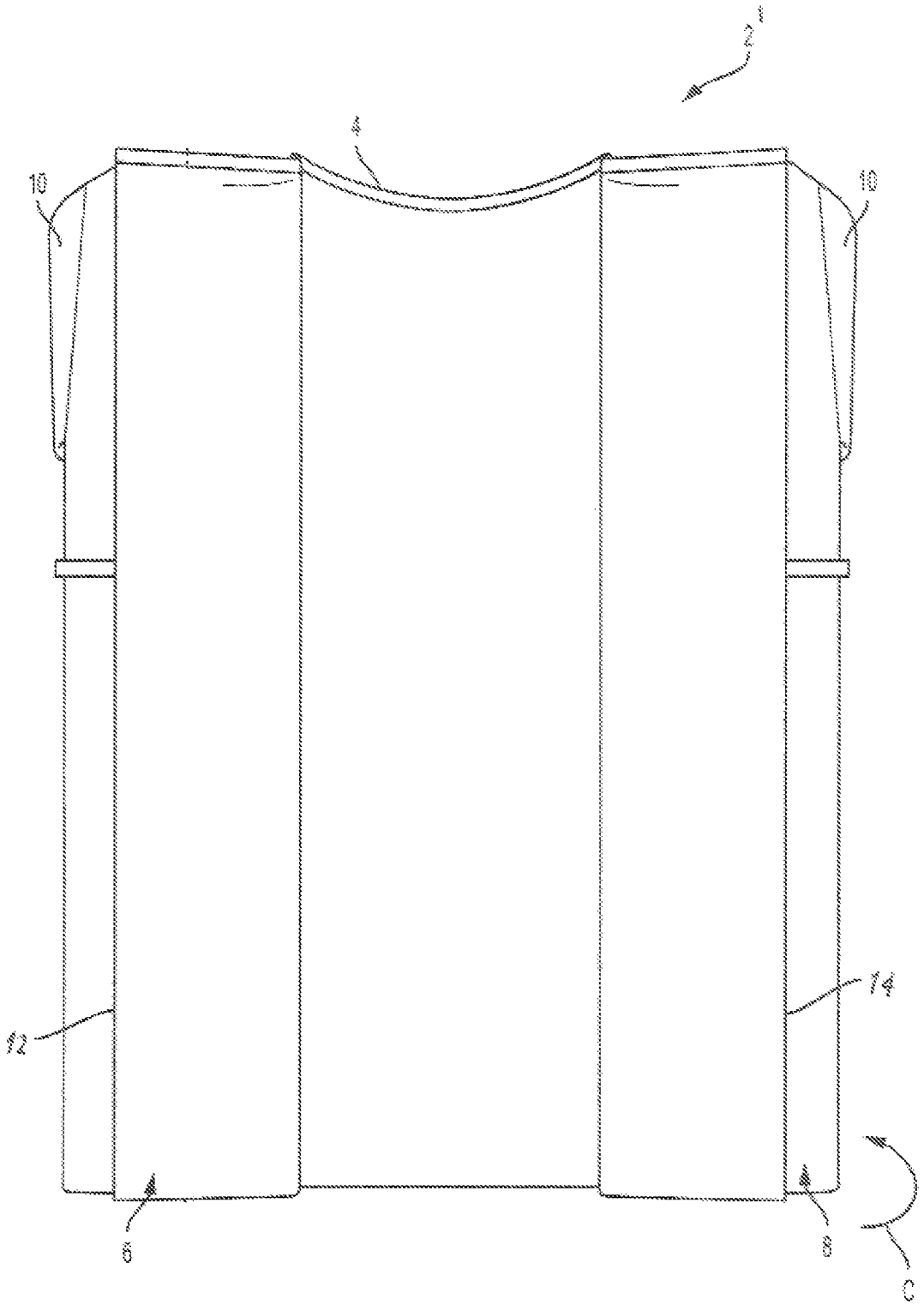
FIG. 9 is a plan view of a surgical gown after a first folding step and showing a second step of folding the gown in a second embodiment.
Figure 10:
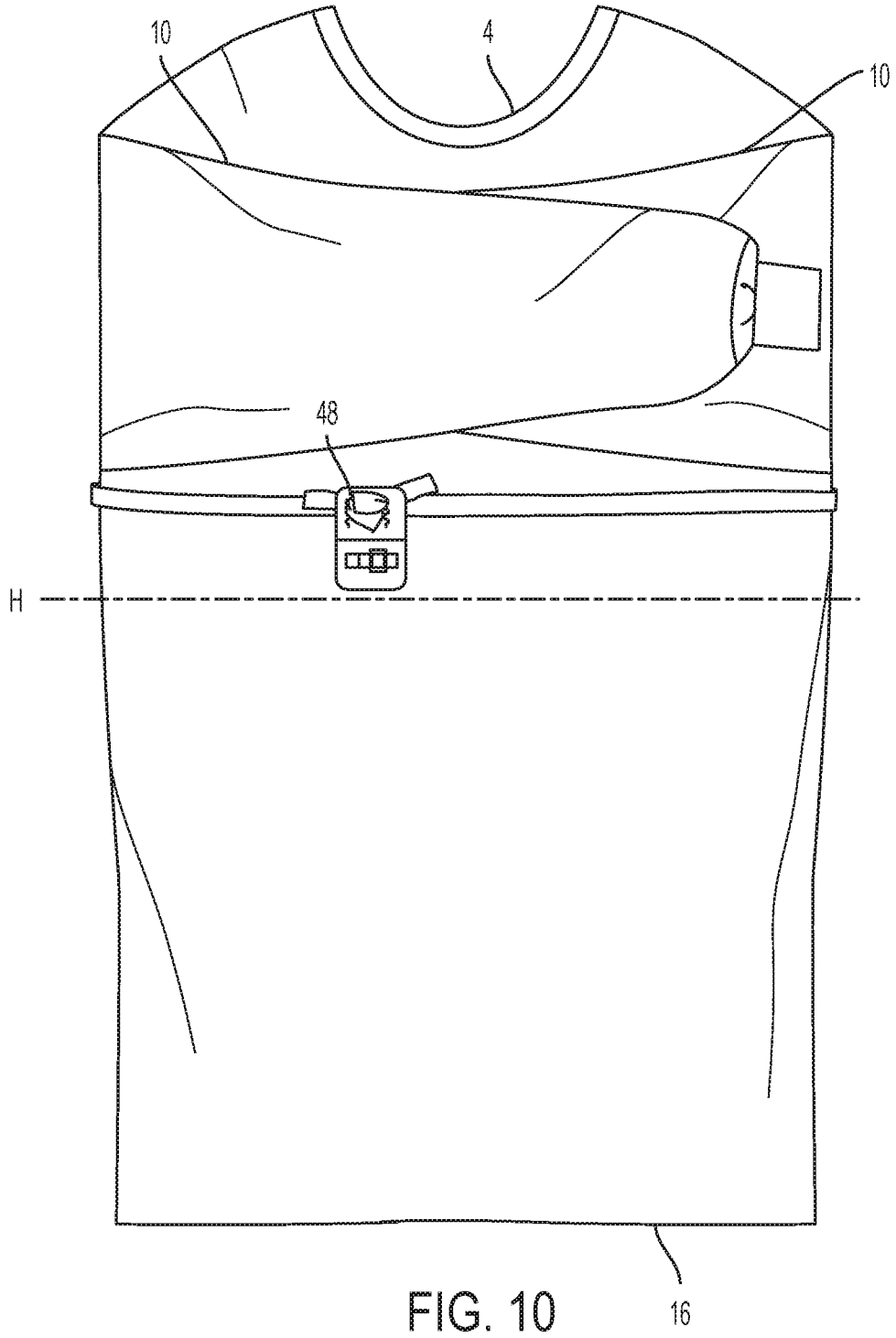
FIG. 10 is a plan view of the surgical gown of FIG. 9 showing the third step in folding the gown.

In an alternative embodiment, shown in FIGS. 9-15, a surgical gown 2' can also be folded in a different method yet result in a similarly folded gown. The gown can also be placed in the same position as shown in FIG. 1. The first fold is similarly made as indicated in FIG. 1, folding the outer edges 12 and 14 toward the central axis A and then folding them partially back out along lines B. The fold that results is shown in FIG. 9. The gown is then flipped over and reversed, as indicated by arrow G in FIG. 9, such that the underside of the gown (i.e., the exterior) is now facing upward and is now the part of the gown exposed, as shown in FIG. 10, The sleeves 10 of the gown are also crossed over each other in the upper half of the gown, as in the previous embodiment. The fold that results is shown in FIG. 10.

Figure 11:
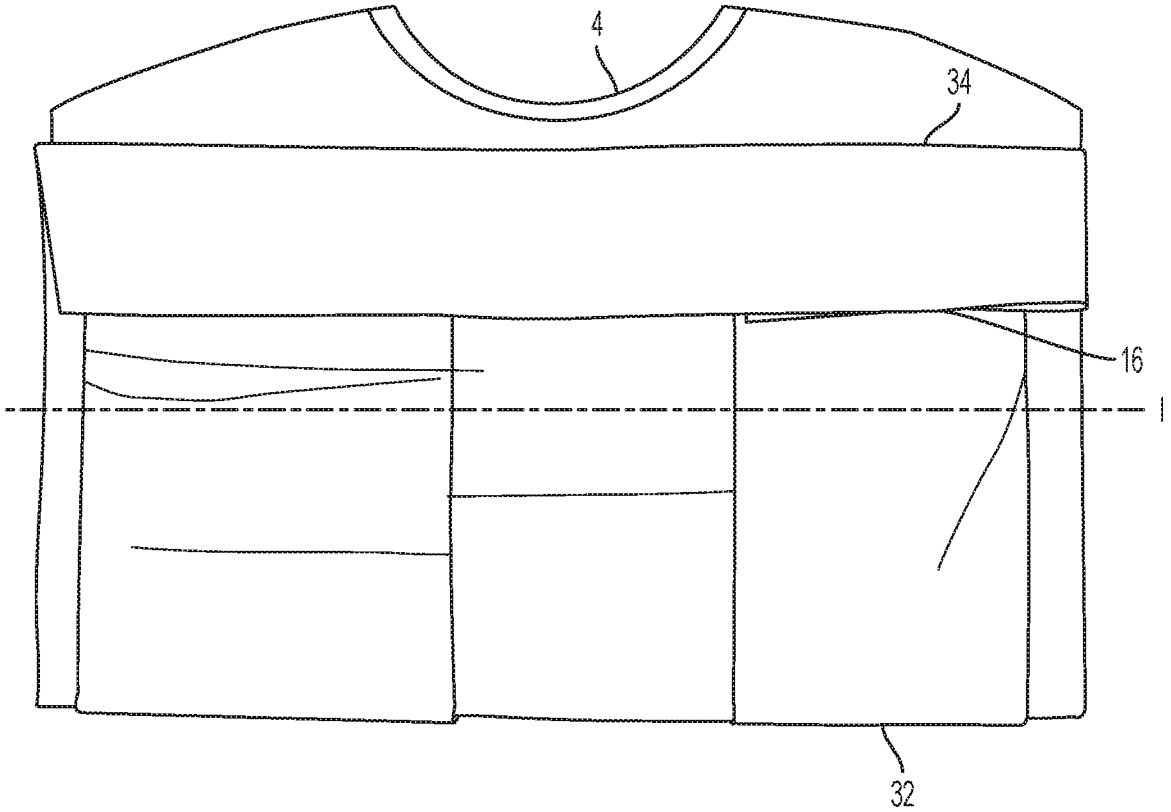
FIG. 11 is a plan view of the surgical gown of FIG. 10 showing the fourth step in folding the gown.
Figure 12:
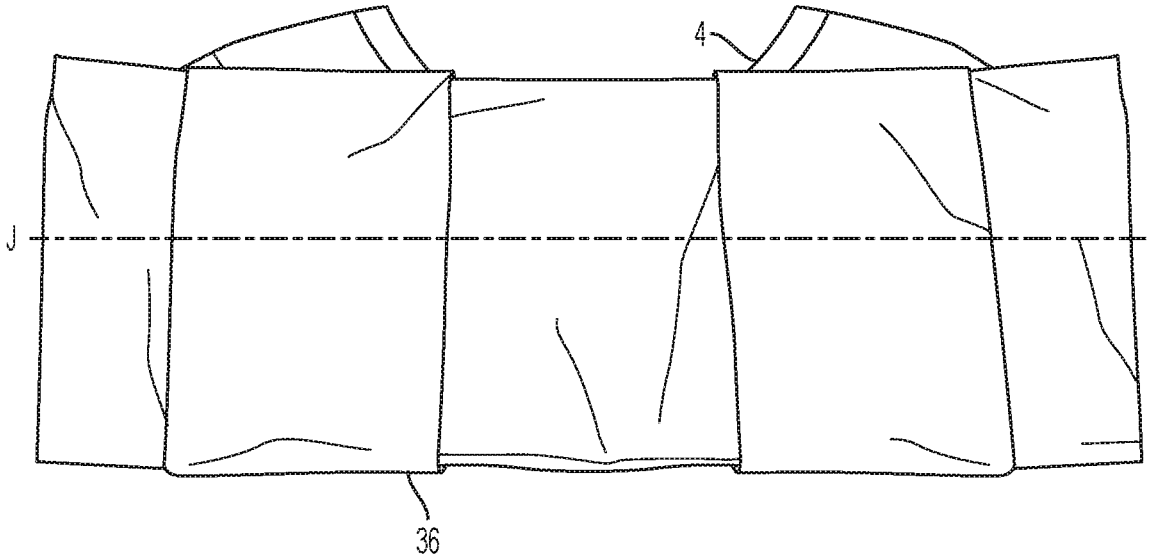
FIG. 12 is a plan view of the surgical gown of FIG. 11 showing the fifth step in folding the gown.
Figure 13:
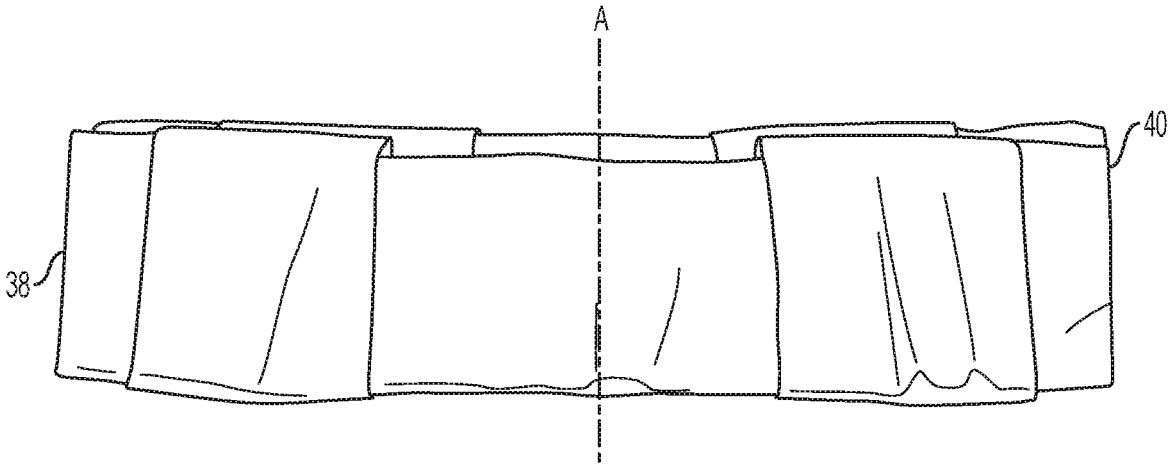
FIG. 13 is a plan view of the surgical gown of FIG. 12 showing the sixth step in folding the gown.

The next fold is made along line H, where the bottom edge 16 of the gown is folded upward along this fold line toward the collar 4, which may partially or completely cover the collar 4. As a result, in order to uncover the collar portion, the folded bottom edge 16 of the gown is folded partially back down, i.e., toward lower folded edge 32, as seen in FIG. 11, just enough such that the collar 4 is uncovered and exposed and a folded upper edge 34 is created. As stated above, folded line H should also be positioned just below the lowermost edge of the tab or belt, depending on which is present and where, utilizing the belt and tab (if present) as a fold guide as discussed above. In this embodiment, the different fold pattern here is due to the alternative placement of the belt and tab, which is higher up on the body, i.e., closer to the sleeves than the previous embodiment.

Figure 14:
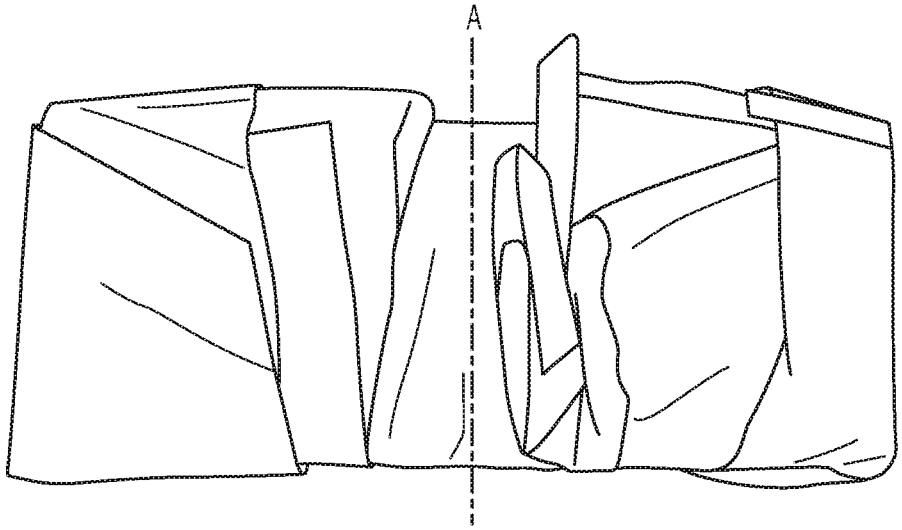
FIG. 14 is a plan view of the surgical gown of FIG. 13 showing the seventh step in folding the gown.
Figure 15:
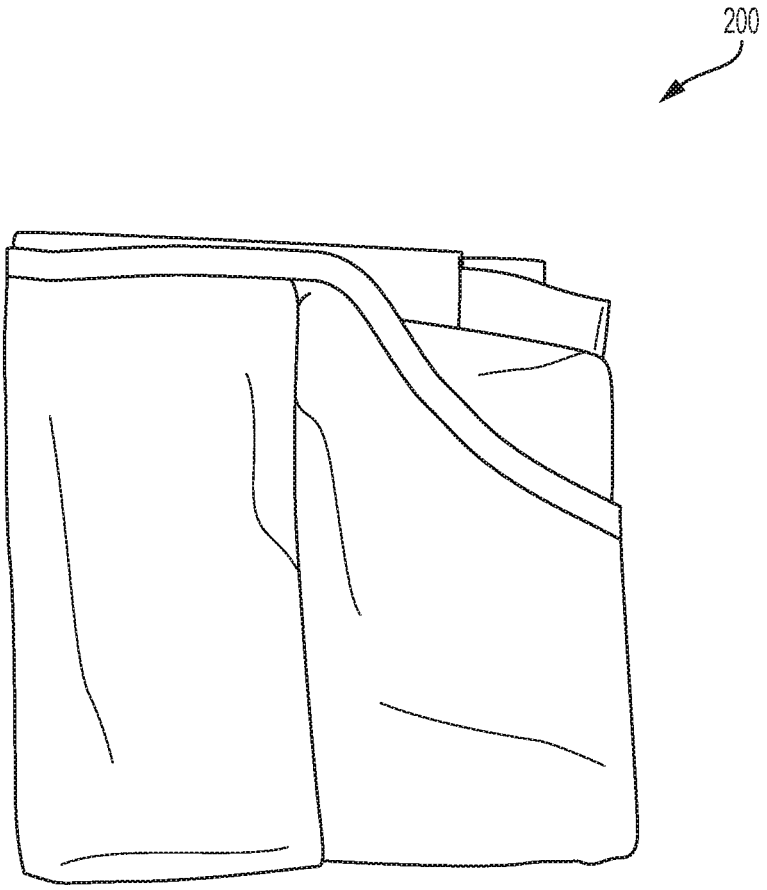
FIG. 15 is a plan view of the finally folded gown of FIG. 14.

The gown is then folded upward from lower folded edge 32 toward the collar, along fold line H as shown in FIG. 11. The resulting fold can be seen in FIG. 12. The gown is then folded upward in half again along fold line J, shown in FIG. 12, where the bottom folded edge 36 is folded upward toward the collar 4, resulting in the fold shown in FIG. 13. The next fold is made along central axis A, folding the two outer edges 38 and 40 inward toward the central axis A such that the outer edges 38 and 40 are folded inward to almost touch the central axis line; the resulting fold is shown in FIG. 14. The final fold is to fold the gown in half once more along central axis A, as shown in FIG. 14, the final folded gown 200 of this embodiment shown in FIG. 15.

Once the gown has been folded it can be optionally first wrapped in a transfer wrap or other type of outer wrap that is typically not sealed, where the transfer wrap can be a spunbond-meltblown-spunbond (SMS) material, a spunbond non-woven material, a medical grade paper; a combination of any of the aforementioned or other appropriate wrap material, and then placed in an overwrap and sealed. The individually packaged gowns can be packed into cartons or cases in order to ship a bulk order of packaged gowns. The overwrap material can be any that is appropriate for packaging surgical gowns yet allow for them to be sterilized after placement in the overwrap and sealed. Possible overwrap materials can include a peelable pouch made of two plastic film layers, a peelable pouch made of a plastic film layer and a porous layer such as medical grade paper or a porous spun bonded polymer material; a thermoform-fill-seal package made of a plastic film bottom web and a plastic film top web, a thermoform-fill-seal package made of a plastic film bottom web and a porous top web such as medical grade paper or a porous spun bonded polymer material, a plastic film bag with a vent made of a porous material such as a medical grade paper or a porous spun bonded polymer material, a rigid plastic thermoformed tray with a plastic film lid, a rigid plastic thermoformed tray with porous lid made from a material such as a medical grade paper or a porous spun bonded polymer material.

The gowns can be sterilized any time after being folded and typically are sterilized after being packaged. The gowns can be sterilized after placement in the overwrap or, alternatively, the gowns can be sterilized after placement in the overwrap and packaged into a case or carton made out of paperboard or other cardboard material.

Upon packaging the gown in the overwrap, sealing the overwrap and then placing the sealed overwrap in the carton, the carton can be sent through the sterilization process. The sterilization process can be any that is standard in the industry; such as ethylene oxide (EO) sterilization. The EO sterilization process uses ethylene oxide gas to infiltrate the carton and, subsequently, the gown package, to reach the gown and atmosphere within the sealed overwrap package. Alternatively, the sealed gown can be sterilized at any other point, such as before packing in the carton or at other desired times. Any other sterilization process appropriate to achieve the desired sterility level can be used. In another aspect, gamma beam sterilization can be employed.

The final dimensions of the folded gown can range from about 6 inches×about 6 inches to about 9 inches×about 9 inches, or any combinations in between (e.g., such that it may not have equal sides on all sides). The material of construction of the surgical gown can be any that is appropriate for hospital or medical settings, such as, for example, a combination of spunbond and meltblown materials such as a spunbond-meltblown-spunbond (SMS) material, a cotton fabric, a multi-layer film laminate, a non-woven material or any combination thereof to achieve the desired barrier performance, Barrier performance of the gowns can be categorized by AAMI level standards, which are commonly used in the industry. For example, an AAMI level 4 gown has a higher barrier performance than an AAMI level 3 gown, while an AAMI level 3 gown has a higher barrier performance than an AAMI level 2 gown, and so on. Any AAMI rated gown can be appropriate for the folding technique described herein.

The final folded gown can be an almost square shape, where the four sides of the folded gown can be about the same length. As seen from FIG. 8, the final folded gown 20 can be oriented such that it has a top edge 50, a bottom edge 52, and two side edges 54 and 56. Along the top edge 50 is part of the collar 4 and part of a shoulder portion 18 of the gown 20. Along the bottom edge 52 are several folded over edges. The outer surface that is visible in the final folded gown 20 is the interior surface 6 of the gown, which is the surface of the gown that can be contacted by the wearer and the wearer's clothing and does not need to maintain sterility.

The right side edge 54 of the folded gown 20 is the main folded over portion that can act like a hinge upon opening and donning the gown, to be discussed in more detail below. This main fold can be positioned at approximately the midpoint of the collar portion. The left side edge 56 consists of a front and back portion (the back portion not shown in FIG. 8), similar to how a front and back cover of a book open. Upon donning the gown, the gown opens up initially between this upper and lower portion at the left side edge 56, pivoting open along the right side edge 54.

Moreover, adjacent the left side edge 56 is a flap 58 that leads to the inside of one of the sleeves 10. A similar flap is located on the opposite side of the folded gown leading to the other sleeve 10. When the wearer is ready to don the folded gown, the wearer begins by placing their hands inside the flaps 58. As the wearer inserts their hands into the flaps 58, they can also begin to open up the gown along the right side edge 54 by unfolding that folded edge. In addition, as the wearer inserts their hands into the flaps 58 in a forward fashion away from their body, there is a passage that their fingers can fit into that point back toward their body. This passage can serve as a gripping point for the wearer to aid in further opening up the gown along the folded edge 54.

As the gown is completely unfolded along the right side edge 54, such that the collar is completely unfolded and facing the wearer, the remaining folds of the gown 20 can begin to unfold and open up simply by the force of gravity acting upon the gown. Once their hands are all the way through the sleeves, an assistant can help to wrap the belt around the gown toward the back and tie it to close the gown in back.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

What is claimed is:

1. A folded surgical gown having an exposed interior surface comprising:

a body portion having a back panel and a front panel, each having an interior surface and an exterior surface and each having a bottom edge along a lower section and a collar portion along an upper section with sleeves attached to the front panel;

the back panel having an opening therein defined by two side edges, where the side edges are folded longitudinally toward a longitudinal central axis of the gown with a second fold folded partially back out upon itself, the sleeves are crossed over one another on the opposite side of the longitudinal folds;

the bottom edge of the gown is folded upward approximately in half toward the collar portion so that an edge of the collar portion is still visible or at least partially visible, the bottom edge just below or flush with the edge of the collar portion, and perpendicular to the longitudinal central axis, covering the folded sleeves;

the gown is folded twice more in the same direction upward toward the collar portion approximately in half each time;

outside edges of the gown are folded approximately in half toward the longitudinal central axis and toward each other such that the outside edges are adjacent one another; and the gown is folded in half again along the longitudinal central axis to result in a final folded gown having only interior surfaces of the gown exposed, wherein a portion of an interior surface of the collar portion is exposed in the final folded configuration.

2. The folded gown of claim 1, wherein the body portion has a belt.

3. The folded gown of claim 1, wherein the back panel and front panel are a single, continuous piece of material.

4. The folded gown of claim 1, wherein the back panel and front panel are two separate pieces of material attached together.

5. The folded gown of claim 1, wherein the final folded gown has dimensions that range from about 6 inches by about 6 inches to about 8.5 inches by about 8.5 inches.

6. The folded gown of claim 1, wherein the final folded gown is packaged in an outer packaging material and sealed within.

7. The folded gown of claim 6, wherein the packaged folded gown is sterilized.

8. The folded gown of claim 7, wherein the packaged folded gown is packed into a shipping carton prior to being sterilized.

9. The folded gown of claim 2, wherein the belt of the gown further includes a tab or other insert for providing a written detail or information about the gown.

10. The folded gown of claim 1, wherein folding the bottom edge of the gown upward approximately in half toward the collar portion covers the collar portion by the bottom edge, such that the bottom edge is folded back down to uncover and expose the collar portion.

11. A method of folding a surgical gown that exposes a portion of an interior surface while not exposing an exterior surface, the steps comprising:

laying the surgical gown flat on a folding surface with the interior surface outwardly exposed and the exterior surface on an opposite side of the gown in contact with the folding surface, the gown comprising a body portion having a back panel that has an opening therein and two side edges that define the opening, a front panel, and sleeves attached to the front panel, where the body portion has a bottom edge at a lower section and a collar portion at an upper section with the sleeves folded underneath the gown;

folding the two side edges inward along two parallel longitudinal fold lines toward a central axis, such that the two side edges are adjacent one another and then folding the two side edges partially back in reverse;

turning the gown over, such that the exterior surface is the upward facing surface and the interior surface is in contact with the folding surface;

folding the sleeves one over the other;

folding the bottom edge of the gown upward along a fold line approximately in half toward the collar portion and covering the folded sleeves, the fold line perpendicular to the central axis, wherein the lower half of the gown is folded upward so that the bottom edge of the gown is just below of or flush with an edge of the collar portion;

folding the gown approximately in half a second time in the same direction upward toward the collar portion so that the collar portion is exposed;

folding the gown approximately in half a third time;

folding outside edges of the gown approximately in half toward the central axis and toward each other such that the outside edges are adjacent one another;

folding the gown in half again along the central axis to result in a final folded gown having only interior surfaces of the gown exposed, wherein a portion of the interior surface of the collar portion is exposed in the final folded configuration.

12. The method of claim 11, further comprising the step of folding the bottom edges of the gown back down toward the lower section of the gown just enough to uncover the collar portion.

13. The method of claim 11, wherein the gown further includes a belt, where the belt is used as a fold guide when folding the bottom edge up toward the collar portion, folding the bottom edge at a position just below the belt.

14. The method of claim 13, wherein the belt further includes a tab or insert that is also used as a fold guide, folding the bottom edge up toward the collar portion along a position just at or below a lower edge of the tab.

15. The method of claim 11, further comprising the step of packaging the final folded gown in an overwrap and sealing the overwrap to result in a packaged gown.

16. The method of claim 15, further comprising the step of inserting the packaged gown into a packing carton with other packaged gowns.

17. The method of claim 16, further comprising the step of sterilizing the packaged gowns contained in the packing carton.

18. A folded surgical gown having an exposed interior surface comprising:

a body portion having a back panel and a front panel, each having an interior surface and an exterior surface and each having a bottom edge along a lower section and a collar portion along an upper section with sleeves attached to the front panel;

the back panel having an opening therein defined by two side edges, where the side edges are folded longitudinally toward a longitudinal central axis of the gown with a second fold folded partially back out upon itself, the sleeves are crossed over one another on the opposite side of the longitudinal folds;

the bottom edge of the gown is folded upward approximately in half toward the collar portion and perpendicular to the longitudinal central axis, covering the folded sleeves and stopping just short of the bottom edge of the collar portion so that the bottom edge is just below of or flush with an edge of the collar portion;

the gown is folded approximately in half a second time in the same direction upward toward the collar portion so that the collar portion is exposed;

the gown is folded approximately in half a third time;

outside edges of the gown are folded approximately in half toward the longitudinal central axis and toward each other such that the outside edges are adjacent one another; and the gown is folded in half again along the longitudinal central axis to result in a final folded gown having only interior surfaces of the gown exposed, wherein a portion of an interior surface of the collar portion is exposed in the final folded configuration.

* * * * *